United States Patent [19]

Lanagan et al.

[11] 3,970,226

[45] July 20, 1976

[54] APPARATUS AND METHOD FOR HOLDING ONE END OF A SHEET TO BE FOLDED

[75] Inventors: John B. Lanagan, Indianapolis; Stephen H. Tilson, Noblesville, both of Ind.

[73] Assignee: The New Folding System Incorporated, Indianapolis, Ind.

[22] Filed: July 28, 1975

[21] Appl. No.: 599,627

[52] U.S. Cl. ..... 223/37; 270/61 R

[51] Int. Cl.[2] ..... A41H 33/00

[58] Field of Search ..... 269/126; 24/249 SA, 24/67 R, 243 K, 243 L, 243 M; 38/12; 223/37, 1; 270/61 R

[56] References Cited

UNITED STATES PATENTS

| | | | |
|---|---|---|---|
| 480,199 | 8/1892 | MacDonald | 38/102.9 |
| 1,982,998 | 12/1934 | Matchett | 24/243 M |
| 2,905,367 | 9/1959 | Coutu | 223/37 |
| 3,131,837 | 5/1964 | Heschl | 223/37 |

FOREIGN PATENTS OR APPLICATIONS

| | | | |
|---|---|---|---|
| 1,472,148 | 1/1967 | France | 24/249 SA |

*Primary Examiner*—G. V. Larkin
*Attorney, Agent, or Firm*—Woodard, Weikart, Emhardt & Naughton

[57] ABSTRACT

An apparatus and method for holding one end of a sheet which is being folded. A first bar is mounted to a frame. A second bar is swingably mounted to the frame and is positioned at all times above the first bar. One end portion of the sheet is extended over the top bar and downwardly between the pair of bars contacting the sheet which is then pulled horizontally taut away from the top bar forcing the sheet end portion against the bottom bar and also forcing the bars together gripping the end portion of the sheet therebetween. The sheet is released by pulling the sheet downwardly. The frame and bars are mounted atop a table having means for supporting the sheet as the end of the sheet is extended between the bars.

8 Claims, 7 Drawing Figures

APPARATUS AND METHOD FOR HOLDING ONE END OF A SHEET TO BE FOLDED

BACKGROUND OF THE INVENTION

1. Field of the Invention

This invention is in the field of sheet holding devices.

2. Description of the Prior Art

Everyone has experienced the difficulties encountered in the folding of a large bed sheet or blanket. Many of the sheets are sufficiently large so as to preclude easy folding of the sheet by a single person. Thus, there have been devices provided for gripping one end of the sheet to allow a person to then fold the sheet as the person walks toward the sheet holding device. One apparatus for folding sheets is disclosed in U.S. Pat. No. 3,510,031 issued to R. B. Robinson. Other folding aids are disclosed in U.S. Pat. Nos. 2,842,823 issued to S. Kopelman, and 3,713,643 issued to R. W. Gerstenberger. Many other clamping devices have been provided in fields completely unrelated to the clothing or bed sheet industry. For example, see the U.S. Pat. Nos. 3,482,288 issued to M. G. Curran relating to a safety harness buckle and 3,497,166 issued to J. T. Di Girolamo, relating to an aircraft arresting device.

The prior art devices typically include various springs and clamps increasing the cost in maintenance as well as decreasing the ease of operation. Disclosed herein is a new and improved device for holding one end of a sheet to be folded with the device relying solely upon the law of gravity for gripping one end of the sheet.

SUMMARY OF THE INVENTION

One embodiment of the present invention is an apparatus for holding an end portion of a sheet to be folded comprising a frame, a first bar with a longitudinal axis mounted to the frame, a second bar swingably mounted to the frame in parallel relationship to the first bar, the second bar having a longitudinal axis above and to the side of the axis of the first bar and means swingably mounting the second bar to the frame operable to allow the second bar to rest adjacent the first bar to grip a sheet therebetween when the end portion extends around the second bar and then between the first bar and the second bar to a position in contact with the sheet which is pulled taut horizontally away from the second bar past and beneath the first bar.

Another object of the present invention is a method of holding, with a pair of separable parallel bars, an end portion of a sheet to be folded comprising the steps of moving one bar above and to the side of the other bar contacting the bars together, extending the second portion of the sheet over the bars, moving the bars apart, extending the end portion downwardly between the bars, and pulling the sheet taut away from the one bar and beneath the other bar forcing the end portion against the other bar.

It is an object of the present invention to provide a new and improved apparatus for holding one end of a sheet to be folded.

A further object of the present invention is to provide a method of holding an end portion of a sheet to be folded.

Yet another object of the present invention is to provide an apparatus principally relying upon the law of gravity for holding an end portion of a sheet to be folded.

Related objects and advantages will be apparent from the following description.

DESCRIPTION OF THE PREFERRED EMBODIMENTS

Figure 1:
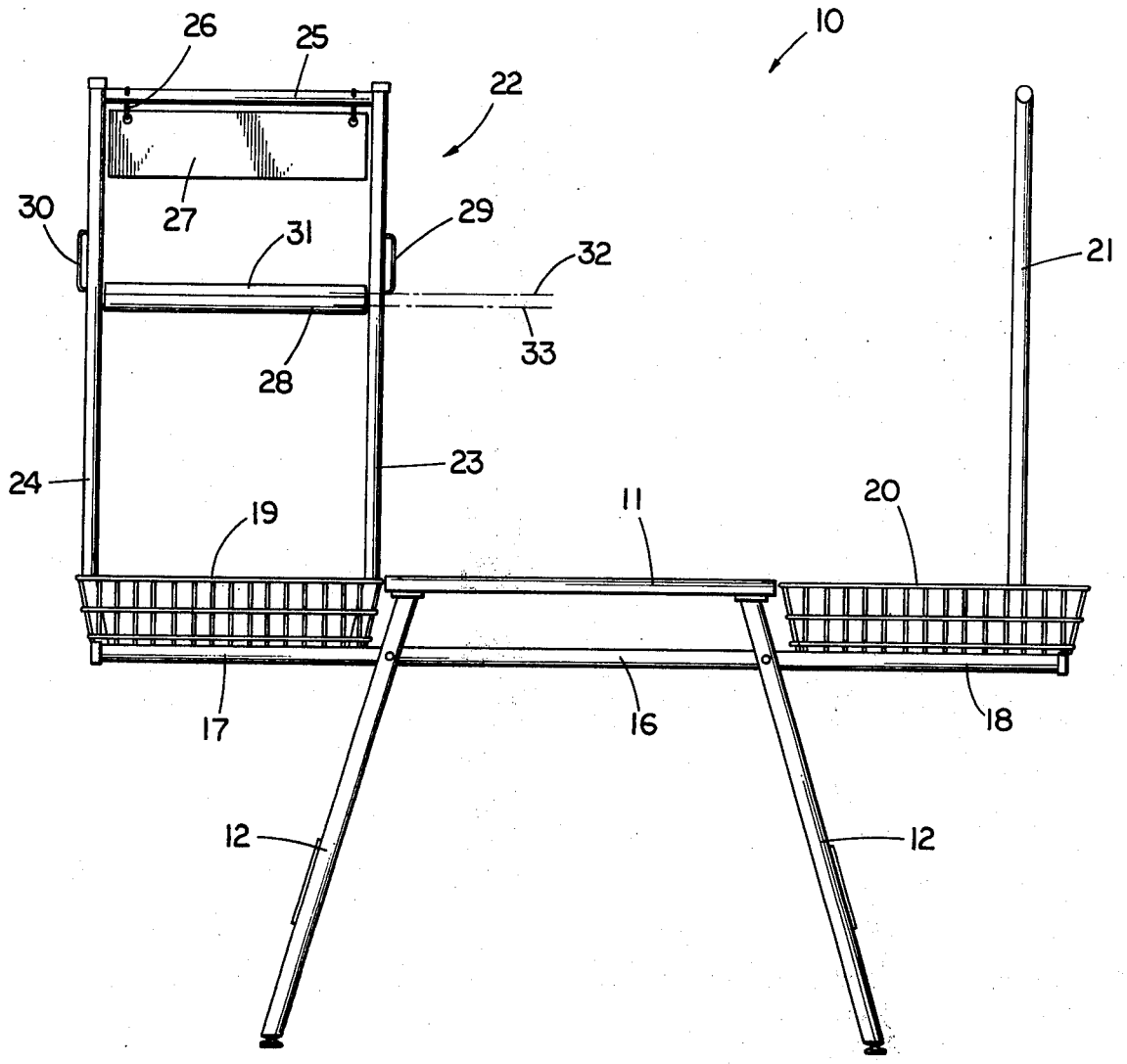
FIG. 1 is a side view of an apparatus incorporating the present invention.
Figure 4:
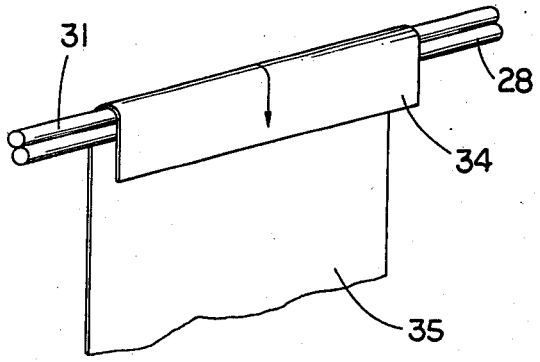
FIGS. 4 through 7 depict various steps of the method disclosed herein for holding one end of a sheet.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
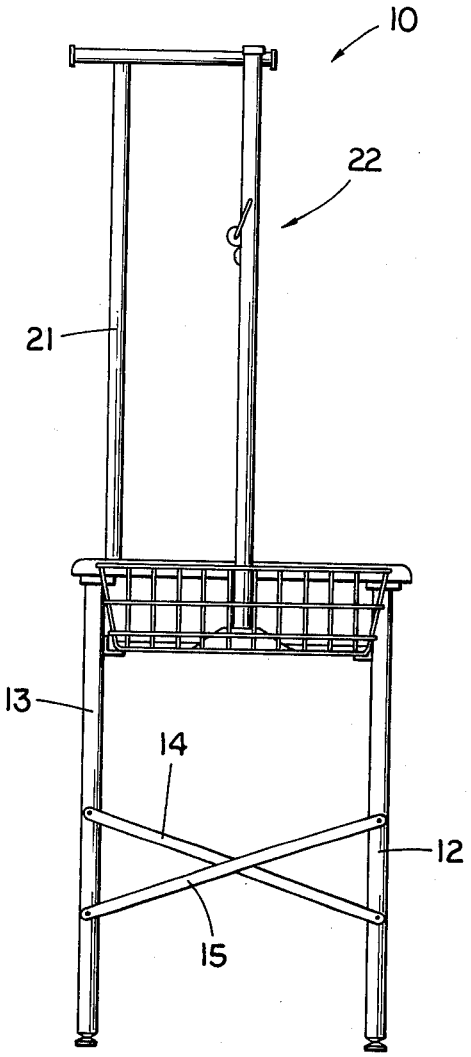
FIG. 2 is an end view of the apparatus of FIG. 1.
Figure 6:
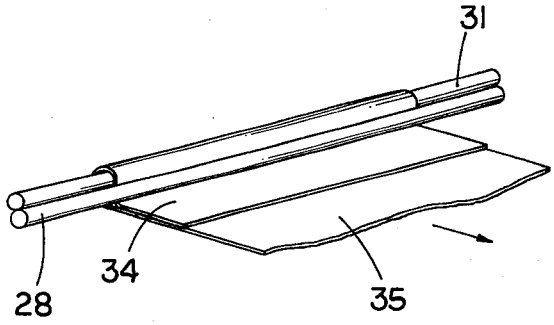

Referring now more particularly to FIGS. 1 and 2, there is shown a table 10 having a horizontally extending top 11 supported by a pair of front legs 12 and a pair of rear legs 13. Front legs 12 extend divergingly from the table top 11 toward the ground. Likewise, the rear pair of legs 13 extend divergingly away from the table top. The front legs 12 are connected to the rear legs 13 by cross braces 14 and 15 at each end of the table. The legs form a generally truncated pyramid design precluding table wobble. A lower horizontally extending shelf 16 is mounted beneath table top 11 to legs 12 and 13. A person using table 10 may therefore store various items, such as purses, coffee, cold drinks and detergent upon shelf 16.

Two additional shelves 17 and 18 are cantileveredly mounted to the legs and extend outwardly supporting a pair of baskets 19 and 20. In one embodiment, baskets 19 and 20 are produced from vinyl coated steel whereas the legs of the table are produced from tubular steel. It will be noted that the top of each basket 19 and 20 is horizontally level with the top surface of table top 11. Thus, clothing from either basket may easily be moved onto top 11.

Garment rack 21 has a vertically extending member fixedly mounted to shelf 18 and a horizontally extending member mounted to the top of the vertically extending member allowing various things to be hung thereon with coat hangers. Fixedly mounted to the opposite shelf 17 is a sheet holder 22 which is operable to hold an end portion of a sheet while a person folds the sheet and walks toward holder 22.

Holder 22 includes a frame having a pair of vertically spaced apart members 23 and 24 fixedly mounted to shelf 17. Members 23 and 24 are secured together by cross brace 25 extending therebetween. Mounted directly beneath cross brace 25 by conventional fastening devices 26 is a card 27 having instructions marked thereon for the use and operation of the folding device.

A first bar 28 is fixedly mounted to and between members 23 and 24. In addition, a pair of arms 29 and 30 have top ends swingably mounted to members 23 and 24. The top ends of arms 29 and 30 are located above bar 28 with the arms extending outwardly of members 23 and 24. The bottom ends of arms 29 and 30 extend inwardly being fixedly connected to the opposite ends of a second bar 31, which is thereby swingably mounted to the frame in parallel relationship to the first bar 28. The longitudinal axis 32 of bar 31 is located above and to the side of the longitudinal axis 33 of bar 28 as shown in FIGS. 1 and 2. Normally, bar 31 rests against bar 28 allowing a sheet to be extended therebetween and gripped by the bars due to the force of gravity of bar 31 against bar 28.

Figure 5:
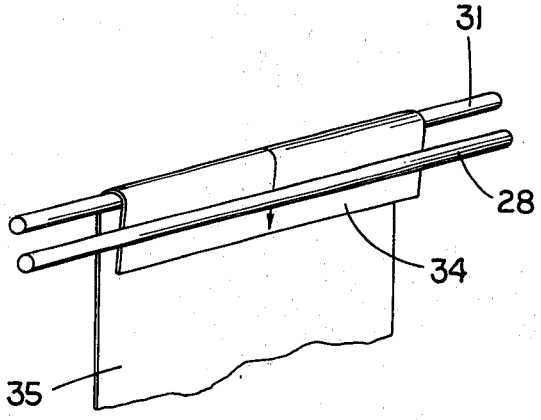
Figure 7:
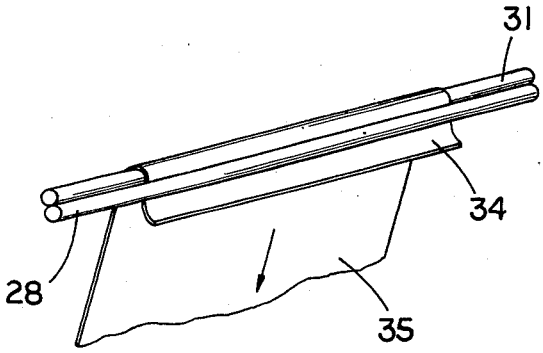

FIGS. 4 through 7 indicate the various steps of the method of holding an end portion of a sheet with bars 28 and 31. First, bar 31 is allowed to rest against bar 28 so as to contact bar 28. The end portion 34 (FIG. 4) of sheet 35 is then extended over bars 31 and 28 with the sheet first extending upwardly adjacent the top bar 31 and then downwardly against bottom bar 28. The bars are then moved apart with the free end 34 of the sheet extending between the bars thereby allowing the sheet to extend wrappingly around the top bar 31 such as shown in FIG. 5. Sheet 35 (FIG. 6) is then pulled taut horizontally away from bar 31 so as to force end 34 of the sheet against the bottom surface of bar 28 thereby also forcing bar 31 toward bar 28 tightly gripping the sheet between the bars. The sheet may then be folded as the person folding the sheet walks toward the holding device. After the sheet is folded, the sheet may be pulled downwardly as shown in FIG. 7 to release the sheet from the bars.

Figure 3:
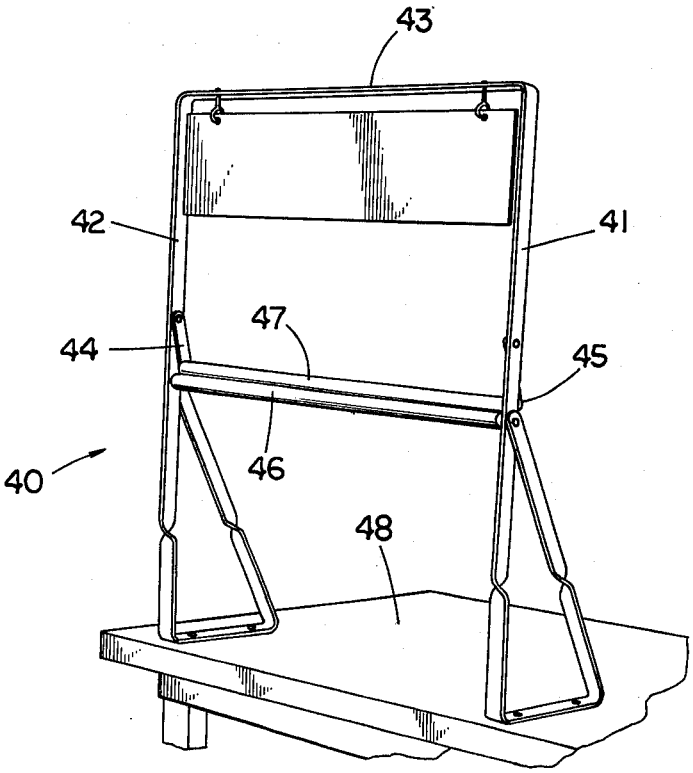
FIG. 3 is a perspective view of an alternate embodiment of an apparatus incorporating the present invention.

An alternate embodiment of the holding device is shown in FIG. 3. Device 40 is identical to the holding device previously described with the exception that the frame is produced from a plurality of flat members 41 and 42 connected together by a flat cross brace 43 in lieu of the tubular members shown for the other embodiment. In addition, arms 44 and 45 are swingably mounted interiorly to members 42 and 41 in lieu of extending outwardly such as arms 29 and 30 with respect to members 23 and 24. Bar 46 fixedly mounted to members 41 and 42 in a manner identical to the mounting of bar 28 relative to members 23 and 24. Bar 47 is fixedly mounted to arms 44 and 45. Likewise, bar 47 is swingably mounted to members 41 and 42 thereby allowing the sheet to be extended over bar 47 and downwardly between bars 46 and 47 in a manner identical to that described and shown in FIGS. 4 through 7. Members 41 and 42 are fixedly mounted to table 48 having a top surface for supporting the sheet during the insertion of one end of the sheet between bars 46 and 47. Basket 19 is provided in the embodiment shown in FIG. 1 to hold and support the sheet as the sheet is extended between bars 28 and 31.

Arms 29 and 30 as well as arms 44 and 45 provide means swingably mounting the top bar to the frame and operable to allow the top bar to rest adjacent the bottom bar to grip the sheet therebetween when the end portion of the sheet extends around the top bar and then downwardly between the pair of bars to a position in contact with the sheet. The sheet is then pulled taut horizontally away from the top bar and past and beneath the bottom bar. In addition, the arms swingably position the top bar above the bottom bar at all times allowing the top bar to move away from the bottom bar releasing the end portion of the sheet when the sheet is pulled downwardly.

It will be obvious from the above description that the present invention provides a new and improved apparatus and method for holding one end of a sheet which is to be folded. While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. Many variations are contemplated. For example, it is to be understood that bars 28, 31, 46 and 47 are shown in the drawings as having a cylindrical configuration although the bars may instead have a flat configuration.

The invention claimed is:

1. An apparatus for use in a sheet folding operation and for holding an end portion of a sheet to be folded comprising:

a frame;

a first bar with a longitudinal axis mounted to said frame;

a second bar swingably mounted to said frame in parallel relationship to said first bar, said second bar having a longitudinal axis above and to the side of said axis of said first bar; and, means swingably mounting said second bar to said frame operable to allow said second bar to rest adjacent said first bar to grip a sheet therebetween when said end portion extends around said second bar and then between said first bar and said second bar to a position in contact with said sheet which is pulled taut horizontally away from said second bar past and beneath said first bar.

2. The apparatus of claim 1 wherein:

said means swingably positions said second bar above said first bar at all times allowing said second bar to move away from said first bar releasing said end portion when said sheet is pulled downwardly.

3. The apparatus of claim 2 wherein:

said means includes a pair of arms with top ends pivotally mounted to said frame above said first bar and with bottom ends connected to opposite ends of said second bar.

4. The apparatus of claim 3 wherein:

said frame includes two vertical spaced apart members with said first bar disposed therebetween, said members are located inwardly of said arms with the bottom ends of said arms extending inwardly past said members to said second bar.

5. The apparatus of claim 3 wherein:

said frame includes two vertical spaced apart members with first bar disposed therebetween, said members being located outwardly of said arms.

6. The apparatus of claim 3 and further comprising:

a table with said frame mounted thereon and extending thereabove, said table having means beneath said bars operable to support said sheet as said end portion of said sheet is extended between said first bar and said second bar.

7. A method of holding, with a pair of separable, parallel bars, an end portion of a sheet to be folded comprising the steps of:

moving one bar above and to the side of the other bar contacting said bars together;

extending said end portion of said sheet over said bars;

moving said bars apart;

extending said end portion downwardly between said bars; and, pulling said sheet taut away from said one bar and beneath said other bar forcing said end portion against said other bar.

8. The method of claim 7 and further comprising the step of:

folding said sheet after said pulling step; and next, pulling said sheet downwardly to release said sheet from said bars.

* * * * *